United States Patent [19]

Pham

[11] Patent Number: 4,955,672

[45] Date of Patent: Sep. 11, 1990

[54] DRAWER INTERLOCK

[75] Inventor: Dinh-Tuong Pham, Hudsonville, Mich.

[73] Assignee: Herman Miller, Inc., Zeeland, Mich.

[21] Appl. No.: 352,280

[22] Filed: May 16, 1989

[51] Int. Cl.[5] ..... A47B 87/00

[52] U.S. Cl. ..... 312/107.5; 312/321; 312/247

[58] Field of Search ..... 312/107.5, 216, 220, 312/221, 222, 245, 246, 247

[56] References Cited

U.S. PATENT DOCUMENTS

| | | | |
|---|---|---|---|
| 159,583 | 2/1875 | Key . | |
| 1,200,882 | 10/1916 | Schaefer | 312/107.5 |
| 1,225,294 | 5/1917 | Weiss | 312/107.5 |
| 1,350,047 | 8/1920 | Way | 312/216 |
| 1,486,094 | 3/1924 | Lehman | 312/107.5 |
| 2,094,155 | 9/1937 | Hodgkinson et al. | 312/222 X |
| 2,597,684 | 5/1952 | Stringe . | |
| 3,199,937 | 8/1965 | Mitchell . | |
| 4,077,684 | 3/1978 | Scherrer . | |
| 4,239,309 | 12/1980 | De Fouw et al. . | |
| 4,355,851 | 10/1982 | Slusser . | |
| 4,394,056 | 7/1983 | Janke . | |
| 4,403,700 | 9/1983 | Manlove | 312/245 X |
| 4,452,498 | 6/1984 | Wood, Jr. et al. . | |
| 4,480,883 | 11/1984 | Young . | |
| 4,624,511 | 11/1986 | Oehme . | |

*Primary Examiner*—Joseph Falk

*Attorney, Agent, or Firm*—Varnum, Riddering, Schmidt & Howlett

[57] ABSTRACT

A drawer interlock for a drawer-and-cabinet assembly wherein a cabinet mounts one or more drawers for sliding movement between a retracted position in the cabinet housing and an extended position at least partially out of the front of the housing. The interlock comprises a latch pivotably mounted to the cabinet back wall proximate to a back wall of the drawer or drawers with the latch having an upstanding catch and a depending catch extending from a central portion in vertical relationship. The latch interfaces with a hook on the drawer or drawers in the cabinet to prevent more than one drawer from opening at one time. The latch is pivotably mounted and biased against the hook in such a way that the latch does not interfere with the movement of any one drawer but will engage a hook when more than one drawer is opened at a time. In a preferred embodiment, each cabinet has one drawer and the latch interfaces with the drawer in the cabinet and with a drawer in an adjacent cabinet, preferably mounted on a wall. Each drawer has two hooks for interfacing with the latch in the cabinet and with a latch in an adjacent cabinet.

19 Claims, 4 Drawing Sheets

DRAWER INTERLOCK

BACKGROUND OF THE INVENTION

1. Field of the Invention

This invention relates to drawer interlock assemblies. In one of its aspects, the invention relates to a drawer interlock assembly in which at least two vertically stacked drawers in one or two cabinets are selectively interlocked to prevent more than one drawer from being opened at one time.

2. State of the Prior Art

It is common practice to mount single drawer-bearing cabinets onto walls in an open office plan configuration, for example. Frequently, more than one cabinet is mounted onto a wall in vertical juxtaposition. Typically only one drawer is opened at a time. However, if more than one drawer is open at a time, the wall may experience a substantial amount of stress or could even become unstable.

Drawer interlock assemblies have been used for many years in freestanding cabinets to prevent multiple drawers from being opened at any given time. Most of these interlock mechanisms are fairly complicated and expensive as well as adapted for single cabinet use.

For example, Oehme in U.S. Pat. No. 4,624,511, issued Nov. 25, 1986, discloses a drawer interlock system in which locking flanges on the back of each drawer interface with pivotably mounted latches which are interconnected by a vertically movable rod to lock the drawers in place. A stabilizing rod mounted at the front of the cabinet engages an unlocking mechanism to permit both drawers to be opened at the same time.

The patent to Stringe, 2,597,684, issued May 20, 1952, discloses a drawer lock mechanism in which rearwardly projecting hooks on the back of the drawer engage a vertically mounted locking rod which is pivotable from a locking and unlocking position.

The Key U.S. Pat. No. 159,583, issued Feb. 9, 1875, discloses a system of folding store shelves and drawers wherein an interlock is provided between an upper shelf cabinet and a lower cabinet to lock the lower cabinet drawers in the cabinet when the shelf cabinet is folded down on top of the lower cabinet portion.

The patent to De Fouw et al., No. 4,239,309, issued Dec. 16, 1980, discloses a drawer interlock system in which a vertically mounted interlock bar on each of the cabinet has a plurality of U-shaped lock members which engage front portions of a drawer when another drawer in the cabinet is opened. The lock bar is vertically movable and actuated by opening of the other drawer.

The Janke U.S. Pat. No. 4,394,056, issued July 19, 1983, discloses a drawer interlock mechanism in which one movable locking bar is provided for each drawer and brackets having outer inclined surfaces are used to raise the bar into non-locking position as the drawer is shut. The mechanism requires a number of brackets on each drawer equal to the number of drawers in the cabinet.

The Wood, Jr. et al. U.S. Pat. No. 4,452,498, issued June 5, 1984, discloses a cabinet drawer interlock in which an L-shaped vertical bracket at a back corner of the cabinet interfaces with L-shaped horizontal brackets mounted to each cabinet drawer to prevent more than one drawer from opening at any given time.

The Slusser U.S. Pat. No. 4,355,851, issued Oct. 26, 1982, discloses a drawer interlock system in which a plurality of blocks and wedges is provided in a channel of a predetermined length and the opening of a drawer in the cabinet moves a wedge member into the channel in sliding contact with the blocks and causes the channel to become fully occupied. A second drawer is thereby prevented from opening because the wedge associated therewith cannot be moved into the channel as the drawer is opened.

The Scherrer U.S. Pat. No. 4,077,684, issued Mar. 7, 1978 discloses a drawer interlock for two side-by-side drawers in which two interlockable pivotable members are positioned between two adjacent sliding drawers such that the withdrawal of one drawer causes the associated pivotable member to pivot and interlock with the other pivotable member and thereby secure the other member in a position which blocks the other drawer from opening.

The Mitchell U.S. Pat. No. 3,199,937, issued Aug. 10, 1965, discloses an interlock mechanism for vertically juxtaposed drawers in a file cabinet wherein a spring-loaded control rod interfaces with flanges on the drawers to lock adjacent drawers when one of the drawers has been withdrawn.

The Young U.S. Pat. No. 4,480,883, issued Nov. 6, 1984, discloses a drawer interlock mechanism for vertically stacked drawers in a cabinet in which a U-shaped channel mounted within the cabinet mounts locking bars and cam elements, the latter of which interact with pins extending from the side walls of each drawer in the vertical stack. As a drawer is withdrawn, the pin interacts with a corresponding cam element in the channel, causing it to pivot and thereby raise the locking bar to a position contacting both the top and bottom caps of the U-shaped channel. In this way, other drawers are prevented from opening when the one drawer is withdrawn.

SUMMARY OF THE INVENTION

According to the invention, there is provided a drawer interlock assembly for a cabinet housing means having side walls, a back wall and an open front. Upper and lower drawers, each having back walls, are mounted in the cabinet housing means in vertical juxtaposed position for horizontal sliding movement between a retracted position within the cabinet housing means and an extended position wherein the drawers can be at least partially withdrawn through the front of the cabinet housing means. The drawer interlock permits only one of the drawers to be opened at a time and comprises a latch pivotably mounted to the cabinet housing means back wall proximate to the back wall of the upper and lower drawers. The latch has an upstanding catch and a depending catch extending from a pivotably mounted central portion in relative vertical juxtaposition to each other. The latch is pivotable about an axis parallel to the direction of sliding movement of the drawers.

A retaining means is mounted to the upper drawer and has a side edge in registry with one side of the latch upstanding catch when the upper drawer is closed and further has an indented notch offset laterally of the side edge and rearwardly of the side edge, which offset notch is adapted to engage the upstanding catch only when the latch rotates toward the retaining means from the side edge engaging orientation and further when the upper drawer is withdrawn slightly from the cabinet housing means.

A retaining means is also mounted to the lower drawer and has a side edge in registry with the latch depending catch at another side thereof when the lower drawer is closed. The lower drawer retaining means further has an indented notch offset laterally from the side edge and rearward of the side edge, the indented notch being adapted to engage a depending catch when the latch rotates toward the lower drawer retaining means and the lower drawer is moved outwardly of the cabinet housing means. A spring or other biasing means bias the latch into engagement with the side edges of both retaining means. In this manner, the upper and lower drawers are able to freely move into and out of the cabinet individually but are prevented from moving out of the cabinet in the event that the other of the two drawers has been moved out of the cabinet.

The invention is adapted for use between drawers each of which are mounted in separate cabinets in vertical juxtaposition on a freestanding wall. However, the invention is also adapted to be used in a multiple drawer-bearing cabinet.

In a preferred embodiment of the invention, the latch is mounted to a back wall of the lower of two single drawer cabinets, the upper drawer retaining means is mounted to a lower portion of the upper drawer and the lower drawer retaining means is mounted to an upper portion of the lower drawer. Desirably, a sloping cam edge is provided between the side edge and the indented notch of the retainer means to guide the catches between the side edges and the indented notch. Further, the outer portion of each of the retaining means has a leading cam face to guide the catches from the outer portion of the retainer means into the indented notches. Typically, each cabinet assembly will have a complete interlock system, including upper and lower retaining means on the drawer back wall and a latch pivotably mounted to the back wall of the cabinet.

BRIEF DESCRIPTION OF THE DRAWINGS

The invention will now be described with reference to the accompanying drawings in which.

DESCRIPTION OF THE PREFERRED EMBODIMENT

Figures 1, 2:
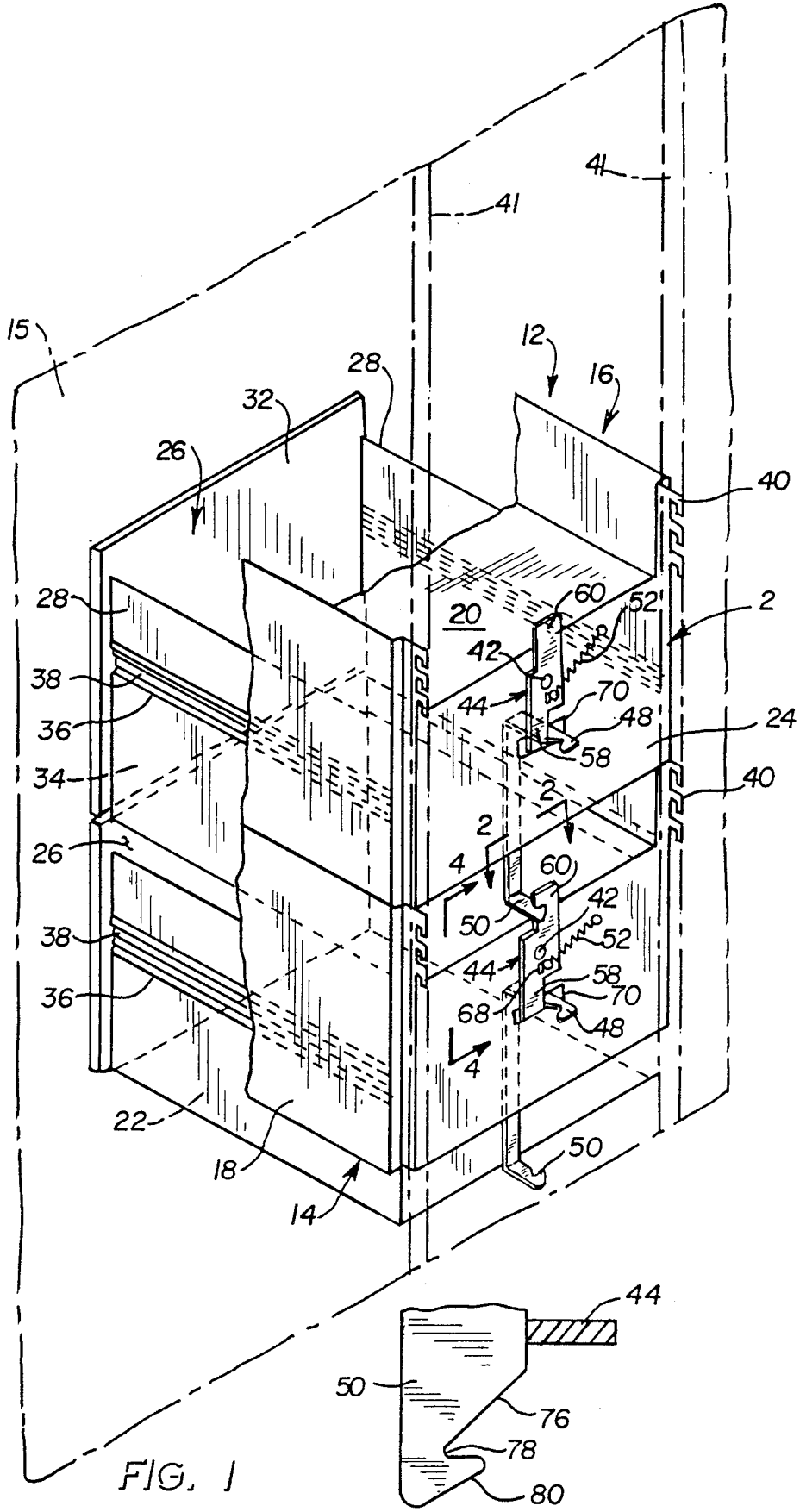
FIG. 1 is a rear perspective view of two vertically stacked single-drawer cabinets illustrating a drawer interlock according to the invention.
FIG. 2 is a partial plan view of the interlock structure shown in FIG. 1 and seen along lines 2—2 of FIG. 1.

Referring now to the drawings and to FIGS. 1-5 in particular, there is shown an upper drawer assembly 12 and a lower drawer assembly 14 schematically represented in vertical relationship with each other from a rear perspective view as the drawer assemblies may be mounted onto a wall 15. The drawer assemblies 12 and 14 are identical and comprise a cabinet 16 having sidewalls 18, a top wall 20 and back wall 24. The top wall 20 is mounted at an upper midportion of the side walls and has the back wall depending therefrom. Clip-forming flanges 40 extend rearwardly from the back portion of the side walls for mounting the cabinet to vertical intelligence rails 41 in conventional fashion. A drawer 26 is suspended within the cabinet and has sidewalls 28, a back wall 30, a front wall 32 and a bottom wall 34. Drawer glides 36 are mounted on the drawer sidewalls 28 through sleeves 37 on the glides 36 and flanged slots 29 on the drawer sides 28. Drawer glides 38 are mounted on the cabinet side walls 18 through pins 39 in conventional fashion to slidably suspend the drawers within the cabinet.

According to the invention, a drawer interlock assembly 42 is mounted to the back of each of the two drawer assemblies 12 and 14 to prevent both drawers from opening at the same time. The drawer interlock assembly 42 comprises a latch 44, which is pivotably mounted to the cabinet back wall 24 through a pivot mounting 46, and a U-shaped retainer mounted to the back wall 30 of the drawer 26 through screws 49. The latch 44 pivots about the pivot mounting 46 about an axis parallel to the direction of sliding movement of the drawers 26. Each U-shaped retainer 47 has an upper leg forming an upper retaining means 48 and a lower leg forming a lower retaining means 50. A spring biasing means 52 is mounted between the latch 44 and the back wall 24 of the lower drawer assembly 14 to bias the latch in a counterclockwise direction as viewed in FIGS. 1 and 3. A screw 54 is mounted to the back wall 24 to limit the degree of rotation of the latch 44 on the back wall 24.

Figure 3:
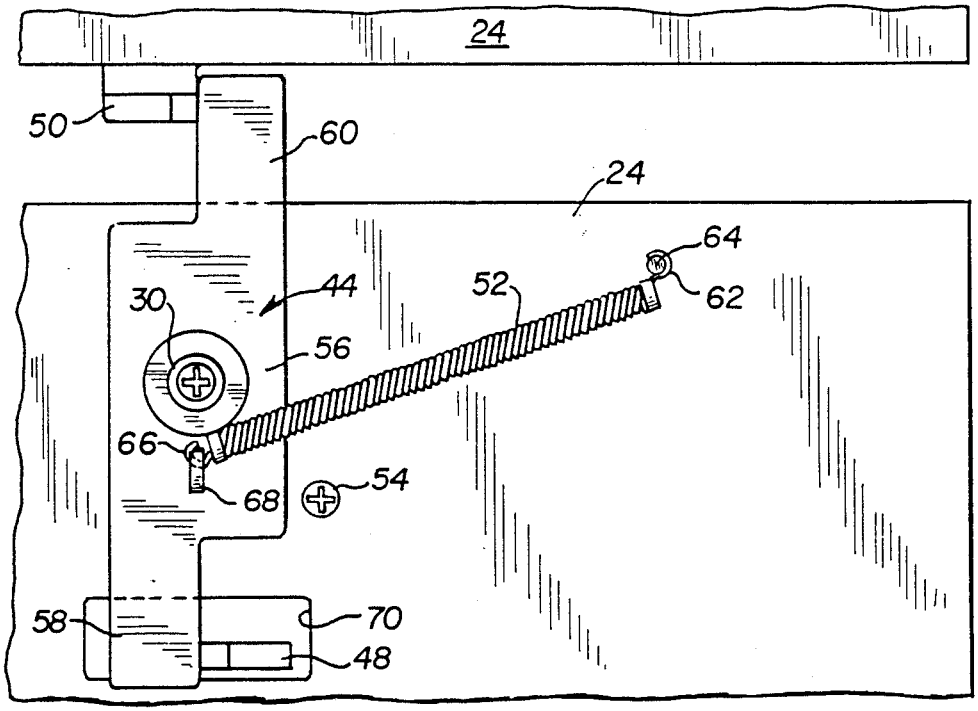
FIG. 3 is an elevational view of the latch assembly shown in FIG. 1.

The latch 44 has a central portion 56 with a depending catch 58 and an upstanding catch 60, both of which extend in a generally vertical direction when the latch is in a neutral position as illustrated in FIGS. 1 and 3. The position of the latch 44 in the generally vertical orientation in contact with one or both side edges 74 of the retainer means 48 and 50 is referred to herein as the side edge engaging orientation.

Typically, the latch 44 is mounted only to those of the cabinets beneath the top cabinet. Thus, in a two-cabinet arrangement, the latch 44 on the upper drawer and cabinet assembly 12 is removed. Alternatively, the latch 44 on the upper drawer and cabinet assembly 12 is disabled by removing the spring 52 and taping or otherwise fixing the latch 44 in a disabled orientation.

The spring biasing means 52 comprises an helical coil tension spring which has a hook 62 on one end and a hook 66 on the other end. The hook 62 is mounted onto a stud 64 on the back wall 24 of the lower drawer assembly 14 and the hook 66 is mounted onto a struck-out portion 68 on the latch 44. As illustrated in FIGS. 1 and 3, the back wall 24 of the lower drawer assembly 14 has an opening 70 therein through which projects the upper retaining means 48 of the lower drawer. The lower retaining means 50 of the upper drawer projects above the top of the back wall 24 of the lower drawer and cabinet assembly 14 for engagement with the latch 44 and beneath the back wall 24 of the upper drawer and cabinet assembly 12.

Figure 5:
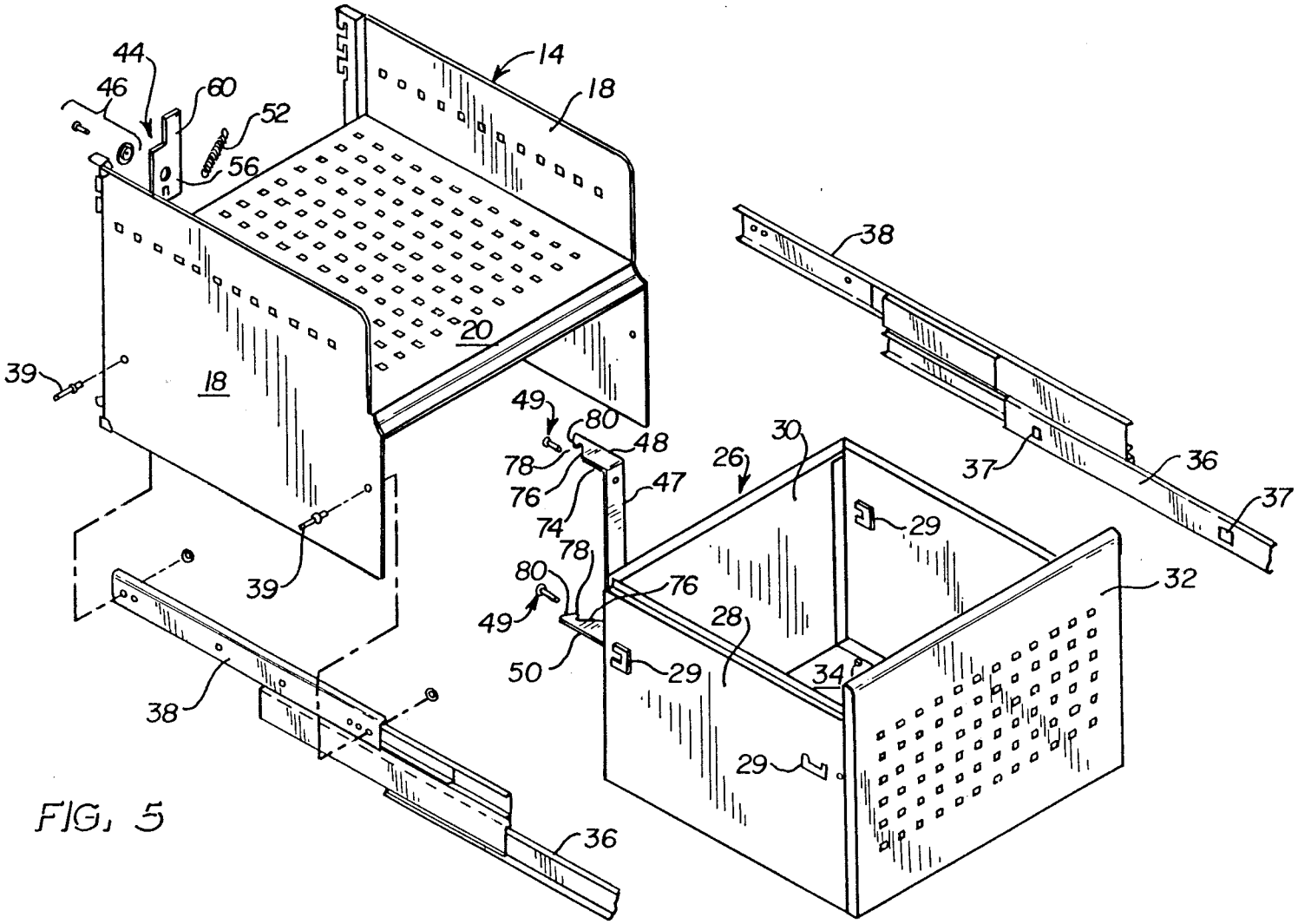
FIG. 5 is a front perspective view of an exploded single-drawer cabinet assembly according to the invention.

As illustrated in FIGS. 2 and 5, each of the upper and lower retaining means 48 and 50, respectively, is substantially identical in shape but opposite in orientation. Each of the retaining means has a side edge 74, a cam face 76, an indented notch portion 78 and a leading cam face 80.

Figure 6:
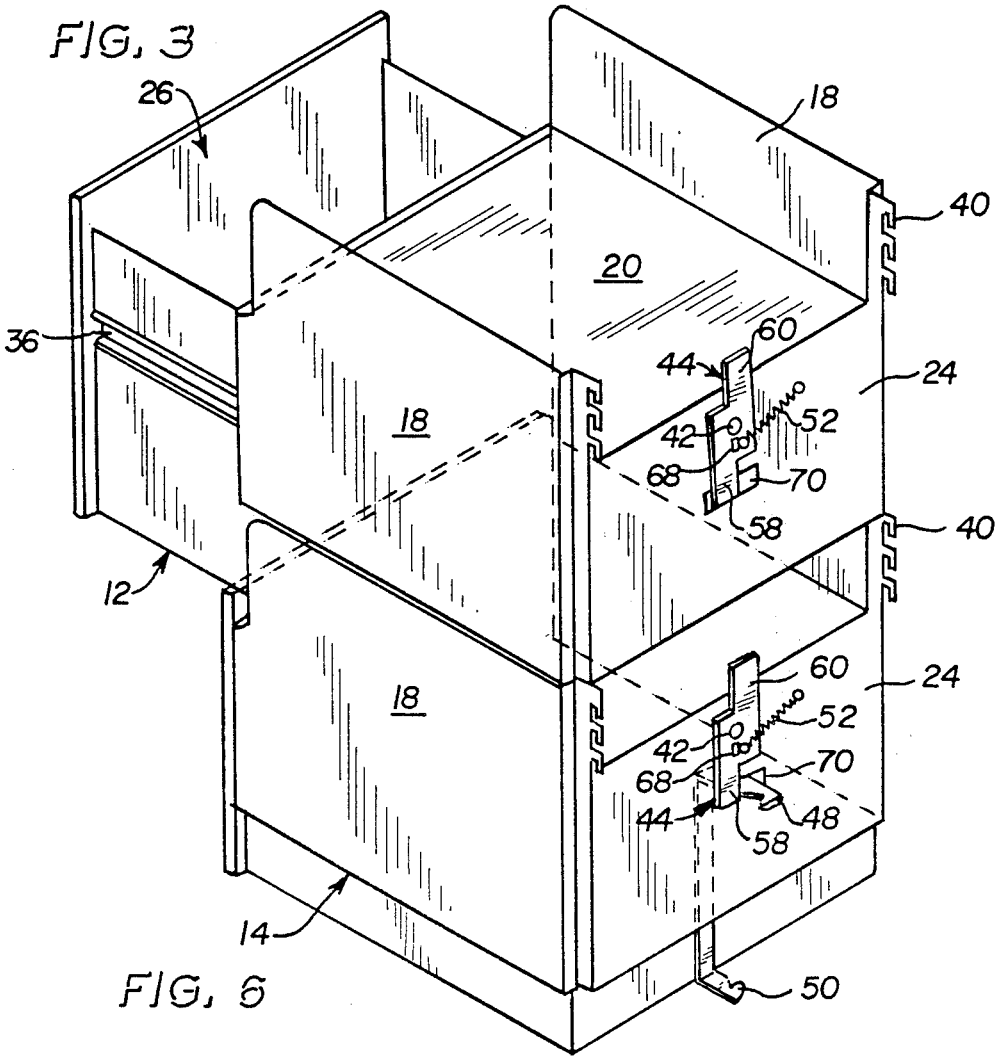
FIG. 6 is a perspective view similar to FIG. 1, but with one of the drawers open.
Figure 7:
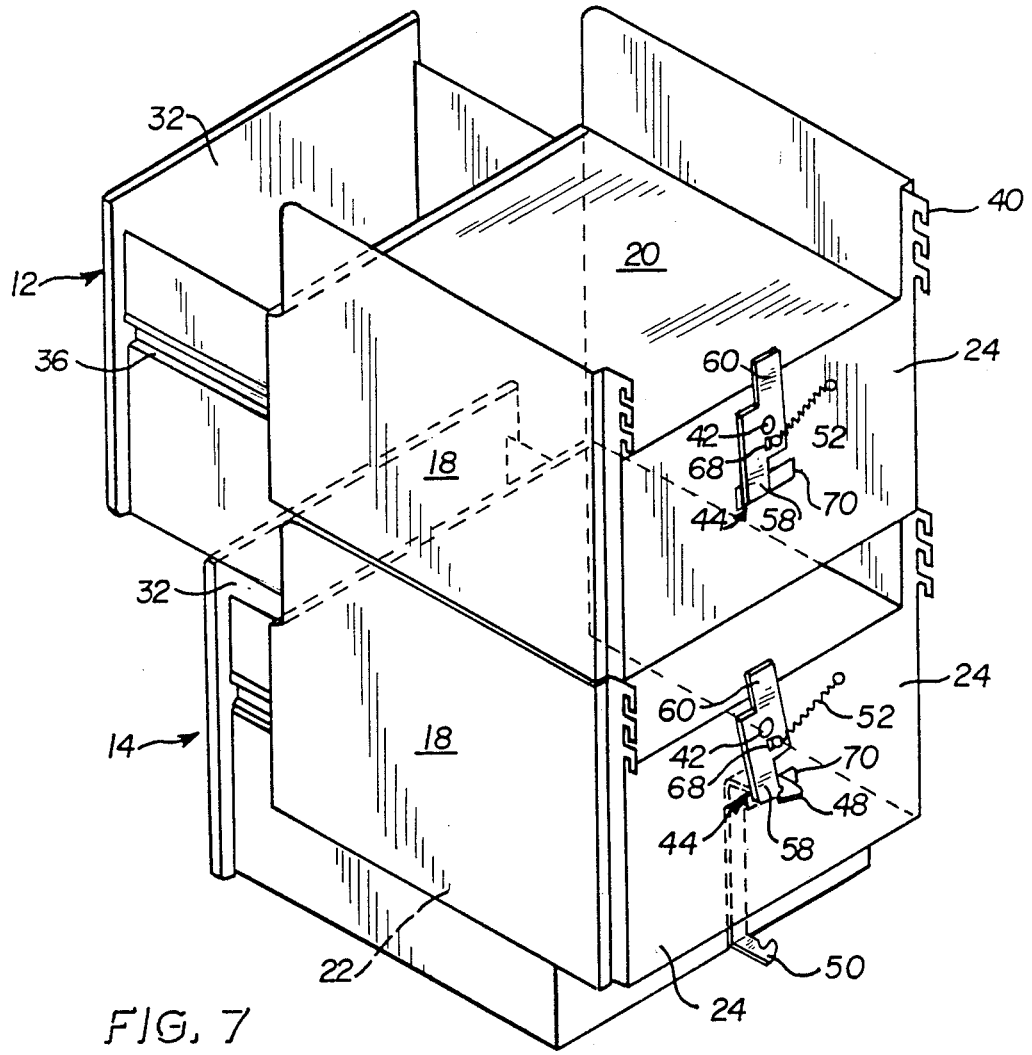
FIG. 7 is a perspective view like FIG. 6 but showing the second drawer partially open and in the latched or locked position.
Figure 4:
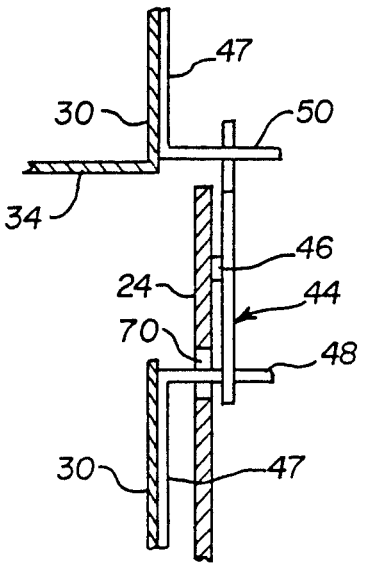
FIG. 4 is a sectional view taken lines 4—4 of FIG. 1.

The operation of the drawers and the drawer interlock assembly will now be described with reference to FIGS. 1, 3, 6 and 7. The orientation of the latch 44 essentially remains the same as illustrated in FIG. 3 at all times when the drawers are closed and when either one of the drawers is open or withdrawn from a respective cabinet. In these conditions, the latch 44, being spring biased in a counterclockwise direction as viewed in FIGS. 1 and 3, for example, bears against one or both of the side edges 74 of the respective upper and lower retaining means 48 and 50 of the lower and upper drawer, respectively. When one of the drawers is open, the latch will remain in the side edge contacting orientation because it rests against the side edge 74 of the retaining means which is mounted to the closed drawer as illustrated in FIG. 5. However, when an attempt is made to open the other drawer, the latch will follow the cam face 76 as the drawer is withdrawn slightly and engage the notch portion 78, thereby preventing the other drawer from opening. This condition is illustrated in FIG. 6. The latch orientation illustrated in FIG. 6 is called the locking orientation. The first drawer can then be closed. The leading cam face 80 on the open drawer will cam against the latch 44, thereby rotating it in a clockwise direction as viewed in FIG. 3 to return the latch to its initial position. The second drawer can then be opened. The leading cam face 80 on the upper retaining means 48 and on lower retaining means 50 also functions to return the latch to the side edge contacting orientation when both drawers are initially inserted into the cabinets.

Whereas the invention has been described with reference to an interlock for hanging single-drawer file cabinets, the invention can also be incorporated into free-standing file cabinets having multiple drawers. In a single cabinet with multiple drawers, a U-shaped retainer would be mounted to each drawer and a latch 44 would be mounted to a back wall or flange at the back of the cabinet for each pair of drawers. The invention can also be used to interlock multiple hanging file cabinets stacked in vertical juxtaposition so long as each file cabinet has a complete interlock assembly.

The invention provides a very simple, inexpensive, yet very effective drawer interlock which can be used in either a single cabinet with multiple drawers or in a hanging file system, wherein each cabinet has but one drawer.

Reasonable variation and modification are possible within the scope of the foregoing disclosure and drawings without departing from the spirit of the invention which is set forth in the appended claims.

I claim:

1. In a drawer and cabinet assembly having a cabinet housing means with side walls, a back wall and an open front, upper and lower drawers, the upper and lower drawers, each having at least side walls and a back wall, are each mounted to the cabinet housing means in vertical juxtaposed position for horizontal sliding movement between a retracted position in the cabinet housing means and an extended position partially out of the front of the cabinet housing means, and an interlock assembly to prevent movement of more than one drawer out of the front of the cabinet housing means at one time;

the improvement in said interlock assembly comprising a latch pivotably mounted to the cabinet housing means back wall proximate to the back wall of the upper and lower drawers, said latch having an upstanding catch and a depending catch extending from a central portion in relative vertical juxtaposition;

a first retaining means mounted to the upper drawer and having a side edge in registry with the latch upstanding catch when the upper drawer is closed, said first retaining means further having an indented notch offset laterally of the side edge and rearwardly of the side edge, said offset notch adapted to engage the upstanding catch only when the latch rotates toward the upper retaining means from the side edge engaging orientation and the upper drawer is withdrawn slightly from the cabinet housing means;

a second retaining means mounted to the lower drawer and having a side edge in registry with the latch depending catch when the lower drawer is closed, said second retaining means having an indented notch offset laterally from the side edge of the lower retaining means and rearward of the same, said second retaining means offset notch adapted to engage the depending catch only when the latch rotates toward the lower retaining means from the side edge engaging orientation and the lower drawer is withdrawn slightly from the cabinet housing means;

means biasing the latch into engagement with the side edges of the upper and lower retaining means;

whereby the upper and lower drawers are able to freely move into and out of the cabinet individually but are prevented from moving out of the cabinet in the event that the other of the two drawers has been moved out of the cabinet.

2. A drawer and cabinet assembly according to claim 1 wherein each drawer is mounted to a separate cabinet and each cabinet is mounted to a wall panel.

3. A drawer and cabinet assembly according to claim 2 wherein the latch is mounted to the back wall of the lower cabinet.

4. A drawer and cabinet assembly according to claim 3 wherein the first retaining means is mounted to a lower portion of the upper drawer.

5. A drawer and cabinet assembly according to claim 4 wherein the second retaining means is mounted to an upper portion of the lower drawer.

6. A drawer and cabinet assembly according to claim 1 wherein the first retaining means is mounted to a lower portion of the upper drawer.

7. A drawer and cabinet assembly according to claim 6 wherein the second retaining means is mounted to an upper portion of the lower drawer.

8. A drawer and cabinet assembly according to claim 1 wherein the second retaining means is mounted to an upper portion of the lower drawer.

9. A drawer and cabinet assembly according to claim 5 wherein each of said first and second retaining means further comprises a sloping cam edge between said side edge and said indented notch to guide said catches between said side edge and said indented notch.

10. A drawer and cabinet assembly according to claim 1 wherein each of said first and second retaining means further comprises a sloping cam edge between said side edge and said indented notch to guide said catches between said side edge and said indented notch.

11. A drawer and cabinet assembly according to claim 5 and further comprising a cam face on the outer portion of each of said first and second retaining means for guiding said catches from an outer end of said retaining means to said indented notch.

12. A drawer and cabinet assembly according to claim 1 wherein said first and second retaining means have a leading cam face at an outer end thereof to guide the catches from the outer end to said indented notch as said drawers are returned into said cabinet.

13. A drawer and cabinet assembly according to claim 1 wherein each of said drawers has a first and second retaining means mounted thereon in vertically juxtaposed position for interfacing with latches at and below the respective drawers.

14. A drawer and cabinet assembly according to claim 1 wherein the first retaining means is in registry with one side of the latch upstanding catch when the upper drawer is closed and said second retaining means is in registry with another side of said latch depending catch when the lower drawer is closed.

15. A cabinet storage system comprising a first drawer and cabinet assembly having a first cabinet housing with side walls, a back wall and an open front and a first drawer slidably mounted in said housing, said cabinet housing further having means for mounting said cabinet onto a wall, a second drawer and cabinet assembly of like construction to the first drawer and cabinet assembly and having a second cabinet and a second drawer, the second drawer slidably mounted in the second cabinet and retaining means mounted on said second drawer, the first and second drawer and cabinet assemblies being adapted to be mounted onto a wall in close proximity to each other, the improvement which comprises:

interlock means mounted to said first cabinet housing and to said first drawer and adapted to extend to and interface with said retaining means on the second drawer when said second drawer and cabinet assembly is mounted on a wall in a predetermined relationship in close proximity to said first drawer and cabinet assembly to prevent said first drawer from opening when said second drawer is open, said interlock means being actuated to prevent said first drawer from opening responsive to opening of said second drawer.

16. A drawer and cabinet assembly according to claim 15 wherein said interlock means comprises a first retaining means mounted on said first drawer and a latch mounted to said cabinet housing, said latch adapted to interface with the first retaining means on the first drawer in the cabinet housing and with a second retaining means on said second drawer in said adjacent cabinet and drawer assembly mounted on a wall in juxtaposition thereto.

17. A cabinet and drawer assembly according to claim 16 wherein said latch is mounted to a back wall of said cabinet housing proximate to the first drawer, said latch having an upstanding catch and a depending catch extending from a central portion thereof in relative vertical juxtaposition.

18. A drawer and cabinet assembly according to claim 17 wherein said first retaining means have a side edge adapted to register with the latch in the cabinet housing or a latch in said adjacent cabinet and drawer assembly when the first and second drawers are closed, said retaining means further having indented notches offset laterally from the side edges thereof and rearwardly of the same, the offset notches adapted to engage the latch only when the latch rotates toward the retaining means from the side edge registering orientation and the drawer is withdrawn slightly from the cabinet housing.

19. A drawer and cabinet assembly according to claim 18 and further comprising means to bias the latch into engagement with the side edge of at least one retaining means.

* * * * *